US005361473A

United States Patent [19]

Landes

[11] Patent Number: 5,361,473

[45] Date of Patent: Nov. 8, 1994

[54] RIVET SETTING ANVIL

[75] Inventor: Hugh D. Landes, Huron, Ohio

[73] Assignee: Heavy Duty Marketing Corporation, Huron, Ohio

[21] Appl. No.: 23,524

[22] Filed: Feb. 26, 1993

Related U.S. Application Data

[63] Continuation-in-part of Ser. No. 911,147, Jul. 9, 1992, Pat. No. 5,189,780.

[51] Int. Cl.[5] ..... B23P 11/00

[52] U.S. Cl. ..... 29/243.53; 29/243.517; 72/391.2; 227/60

[58] Field of Search ..... 29/243.517, 243.518, 29/243.53, 243.54, 524.1, 525.2; 72/391.2, 453.19; 227/53, 55, 57, 60

[56] References Cited

U.S. PATENT DOCUMENTS

| | | | |
|---|---|---|---|
| 2,564,782 | 8/1951 | Franz | 227/60 |
| 3,179,319 | 4/1965 | Barker et al. | 227/60 |
| 4,177,545 | 12/1979 | Lambertz | 29/524.1 |
| 4,918,798 | 4/1990 | Reed | 29/243.53 |

FOREIGN PATENT DOCUMENTS

| | | | |
|---|---|---|---|
| 596988 | 11/1925 | France | 227/60 |
| 2162114 | 1/1986 | United Kingdom | 29/294.54 |
| 0831281 | 5/1981 | U.S.S.R. | 29/294.53 |

*Primary Examiner*—David Jones

*Attorney, Agent, or Firm*—Pearne, Gordon, McCoy & Granger

[57] ABSTRACT

A rivet setting anvil is provided with a replaceable clinching head that allows the rivet rolling surface to be replaced without replacing the entire anvil. The clinching head may be threaded to the pedestal portion of the anvil or retained with a releasable locking arrangement.

24 Claims, 2 Drawing Sheets

RIVET SETTING ANVIL

This application is a continuation-in-part of application Ser. No. 911,147, filed Jul. 9, 1992, now U.S. Pat. No. 5,189,780.

BACKGROUND OF THE INVENTION

The present invention relates to riveting apparatus and methods. More particularly, the invention relates to improved anvil devices and novel riveting methods including replacement of disposable anvil heads.

It is known to provide elongate rigid anvils for setting tubular or semi-tubular rivets. The anvils are composed of an elongate hollow cylinder, one end of which is retained in the riveting machine and the other having a rivet clinching or clenching surface. Typically, a pilot pin or roll pin is located within the cylinder, the end of the pin being extendable through the clinching surface. The pin is spring-loaded to extend from the clinching surface an amount limited by a shoulder on the pin contacting a shoulder within the cylinder.

Tubular or semi-tubular rivets include a relatively large diameter head portion and a reduced diameter tubular or cylindrical portion which is hollow along at least a portion of its longitudinal length to form a rivet bore. The diameter of the rivet bore varies in accordance with rivet size, and a correspondingly sized anvil having a suitably sized pin and clinching surface is required to set or clinch the rivet. For example, truck brake shoe linings are typically assembled with ¼" or 3/16" diameter rivet by various manufacturers. The anvils are elongate to allow the anvil to reach into irregular shaped work pieces such as brake shoes.

The anvil is mounted in a mechanically, pneumatically or hydraulically operated riveting machine for closing movement with a driver head arranged to engage the remote side of the rivet head. The work pieces to be joined are positioned between the anvil and the driver head. The anvil pilot pin extends through a riveting hole in the work pieces to be joined and into the bore the tubular or semi-tubular rivet. As the head of the rivet is driven towards the anvil, the pilot pin guides the rivet through the work piece, retracting as it goes.

As the end of the pilot pin nears the clinching surface, the pin bottoms out and the wall of the rivet starts expanding by being forced over the now stationary pin.

When the wall of the rivet contacts the clinching surface it is rolled radially outward and then back against the work piece. This clinching surface is made up of a cupped annular rivet rolling surface located about the pilot pin. After removal of the work piece, the spring loaded pilot pin again extends in preparation for the next rivet.

The annular rivet rolling surface is critical to the proper clinching of the rivets. To insure proper clinching, the rivet rolling surface is highly polished. If it becomes damaged or worn, rivets may split or fail to clinch properly. This lessens the strength and durability of the riveted connection between the parts and, in some cases, causes failure to meet product specifications. In the latter case, the part must be returned to the manufacturing line for removal of the defective rivet and, in some instances, all other simultaneously made rivet connections, so that the part may be processed once again in the riveting machine. All such corrective processing is costly.

Not only does the rolling surface wear, but many times a piece of foreign matter will damage the rolling surface of a nearly new anvil. In either case, heretofore, the entire anvil had to be replaced.

Heretofore, the anvil cylindrical portion and clinching head were integrally formed to assure stability of the elongate anvil tool and alignment of the pilot pin within the anvil bore and the rivet during the life of the anvil. Such integral or one piece construction was believed necessary to a satisfactory anvil life wherein high riveting loads are intermittently applied and work pieces are aligned for each rivet cycle.

SUMMARY OF THE INVENTION

The rivet setting anvil includes a pedestal having distal and proximal ends, an outside wall and a longitudinal bore. Also included is a clinching head having a clinching portion, an attaching portion and a bore therebetween. The attaching portion is removably attached to the proximal end of the pedestal and the bores are in communication. The clinching portion has an annular rivet rolling surface located about the head bore. A pilot pin is slidably retained in the bores, a portion of the pin being extensible from the clinching portion. Means are included for urging the pilot pin to extend from the clinching portion. In this manner, a disposable head anvil is provided.

In the illustrated preferred embodiment, the attaching portion has male threads and the bore of the pedestal has female threads at the proximal end of the anvil. The threads cooperate to removably attach the head to the pedestal. A threaded connection between the anvil pedestal and clinching head has been found to provide satisfactory anvil life without loss of pilot pin alignment through the bore. A portion of the threads may be error threads for providing friction to lock the head to the pedestal during use.

The anvil may be provided with an acircular cross-section at some point along its longitudinal length, e.g. contraposed flats to facilitate connecting and disconnecting the head and pedestal portions as by threading and unthreading the attaching portion to the pedestal.

In other illustrated embodiments, the attaching portion is slidably received in the bore of the pedestal at the proximal end thereof. The attaching portion is removably locked to the pedestal by axially interfering or mechanically interlocking surfaces such as set screw, detent and bayonet or twist lock arrangements. Preferably, a rigid assembly of the clinching head and pedestal is provided in all cases, and the riveting loads are borne by abutting radial surfaces of the head and pedestal as opposed to mechanical interlocking surfaces. This tends to extend the life of the anvil by enhancing the maintenance of anvil rigidity through out multiple riveting cycles. In each of the illustrated embodiments, the attaching portion has a shoulder about the head bore and the pin has a shoulder intermediate its length. These shoulders act to limit the extension of the pin from the clinching portion.

Because the clinching portion of an anvil (the work area) needs to be made from a highly durable grade tool steel, the entire prior art anvil had to be made of the same steel.

The present invention cost effectively allows the pedestal to be made from less expensive grade tool steel, while the smaller clinching portion can be made of higher quality, more durable tool steel. This economically increases the lifetime of the working surface.

In accordance with the invention, the clinching head and pilot pin may be changed to accommodate different rivet sizes. As noted above, truck brake shoe linings typically employ ¼" or 3/16" rivet sizes. Accordingly, a single set of rivet anvils may be assembled with differently sized sets of clinching heads and pins without removing the anvils from the riveting machine to enable different rivet sizes to be processed. The use of one anvil pedestal to accommodate several different rivet sizes provides an economic savings over prior art anvils which had to be changed in-total to accommodate different rivet sizes.

In accordance with the riveting methods, the rivet setting anvil of the invention allows for the replacement of the working part, e.g. the rivet rolling surface, rather than the entire anvil. The cost of replacing only the clinching portion is a fraction of the cost of an entire prior art anvil. The disposable head anvils of the invention tend to maintain tool rigidity and longitudinal alignment throughout the tool life with uniform clinching of rivets.

DESCRIPTION OF THE PREFERRED EMBODIMENTS

Figure 1:
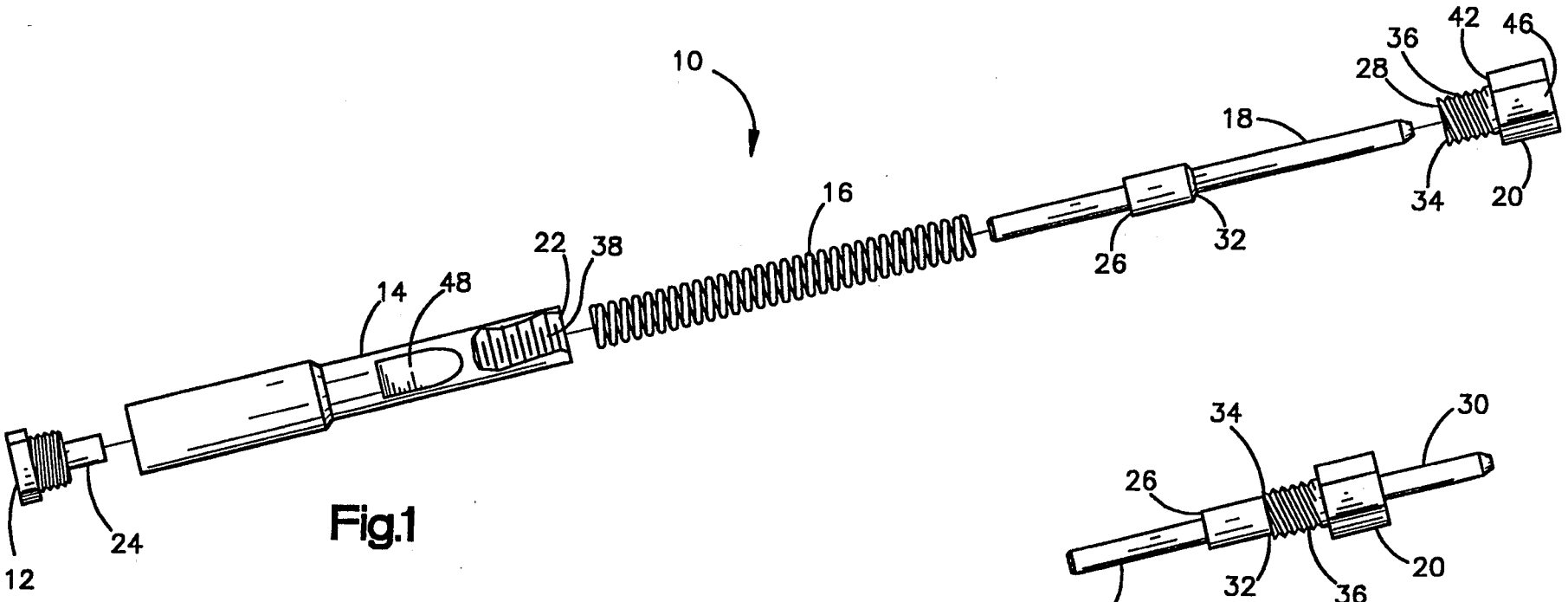
FIG. 1 is an exploded perspective view of a disposable head rivet setting anvil having a threaded attaching portion according to the invention.
Figure 2:
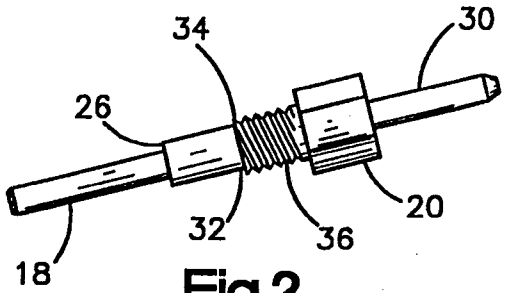
FIG. 2 is a perspective view of an assembled portion of the anvil of FIG. 1.

Referring to FIGS. 1 and 2, a rivet setting anvil 10, is assembled from a threaded end plug 12, a hollow pedestal or anvil support portion 14, a spring 16, a pilot pin 18, and a clinching head or rivet setting portion 20.

The plug 12 is threaded into the open bottom of the pedestal 14 which has mating threads. The spring 16 is inserted into a longitudinally extending bore 22 of the pedestal 14 from the proximal end of the pedestal opposite the plug 12. The bottom end of the spring 16 seats against the plug 12 and surrounds a pin 24 that extends from the plug 12.

The pilot pin 18 is inserted into the bore 22 as well as into the inside of the spring 16. The end of the spring 16 bears against the shoulder 26 on the pilot pin 18, forcing the spring 16 to be compressed as the pilot pin 18 is inserted.

The pilot pin 18 is also inserted into the bore 28 of the clinching head 20, a portion 30 of the pilot pin 18 extending through and beyond the clinching head 20. The portion 30 is limited by contact of a shoulder 32 on the pilot pin 18 with an internal shoulder 34 on the clinching head 20.

The clinching head 20 has a male threaded attaching portion 36 which mates with a female threaded attaching portion 38 within the bore 22 of the pedestal 14. The clinching head 20 and pedestal 14 together with their aligned bores 28 and 22 thereby cooperate to provide the anvil 10 with an elongated body having a central longitudinal bore. The assembled clinching head 20 and pedestal 14 are rigidly secured together with radial end surface 40 of the pedestal 14 engaging a radially extending shoulder 42 of the head 20. Thus, the riveting loads are substantially carried by the aligned radially extending surfaces 40 and 42 to enhance the stability and life of the anvil 10.

When the plug 12 and the clinching head 20 are threaded into the pedestal 14 the pilot pin 18 is urged by the spring 16 to extend portion 30 from the clinching head 20. The extent to which the pilot pin 18 may be forced into the bore 22 of the pedestal 14 is limited by contact between the pin 18 and the pin 24.

Figure 3:
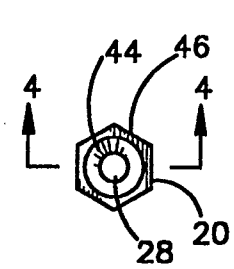
FIG. 3 is a top plan view of the clinching head of the anvil of FIG. 1.
Figure 4:
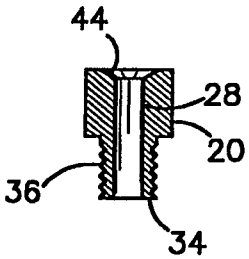
FIG. 4 is a cross sectional view along the line 4—4 of FIG. 3.

Referring to FIGS. 3 and 4, an annular rivet rolling surface 44 is provided at the end of the clinching head 20.

The surface 44 is critical to the proper clinching of a rivet. To minimize wear and damage to the surface 44, the clinching head 20 may be formed from a material more wear resistant than that of the pedestal 14, for example, S-7 tool steel.

The shoulders 32, 34 are another location of significant wear in the anvil 10. The invention also allows the wear surface of the shoulder 34 to be replaced without replacing the entire anvil 10. It should also be noted that the shoulder 34 also benefits from the clinching head 20 being made from a higher grade material.

To aid in preventing the clinching head 20 from vibrating loose from the pedestal 14, the threaded attaching portion 36 (and/or its mated threaded attaching portion 38 in bore 22) may be provided with one or more error threads, that is, threads at a slightly different pitch (not readily visible) than the others (e.g. 19 threads to the inch instead of 20). The error threads increase the friction between the pedestal 14 and the clinching head 20 to prevent inadvertent loosening. Other thread locking techniques may be used to assure maintenance of tightly threaded engagement.

In addition, ease of replacement of the clinching head 20 can be enhanced by providing the head 20 with pairs of flats 46 on opposite sides of the hexagonal shape of the clinching head 20 as shown in FIG. 3. Similarly, the pedestal 14 may be provided with one or more flats 48 in its outer surface as shown in FIG. 1. These flats 46 and 48 allow a tool such as a wrench to readily engage the parts of the anvil 10 for assembly/disassembly.

Figure 5:
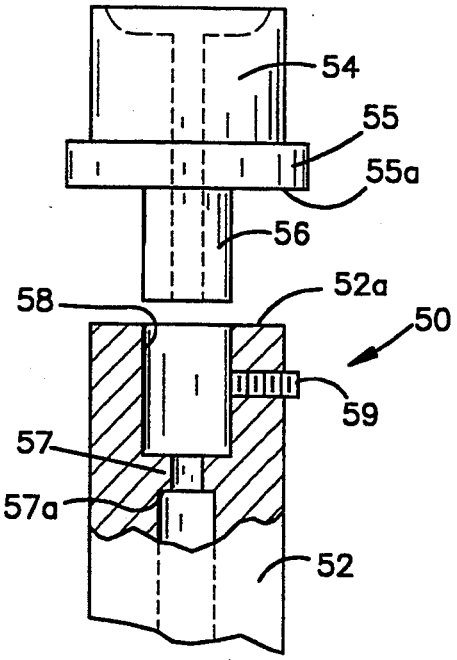
FIG. 5 is a diagrammatic elevational view, partially in section, showing a disposable head anvil having an un-threaded attaching portion and a locking set screw in accordance with another embodiment of the invention.

Referring to FIG. 5, a disposable head riveting anvil 50 includes a hollow pedestal 52 having a clinching head 54 rigidly mounted thereto. The anvil 50 is similar to the anvil 10 except for the mounting arrangement of the head 54 to the pedestal 52 as described below.

The head 54 includes an un-threaded attaching portion comprising a cylindrical head extension 56 of reduced diameter for slidable receipt in a correspondingly shaped attaching portion comprising a cylindrical bore 58 in the proximal end of the pedestal 52. The attaching portions 56 and 58 are sized to provide a tight mechanical fit to maintain alignment of the bores through the anvil 50. The attaching portion 58 is retained in the bore 58 by a set screw 59 which is threadedly engaged with the pedestal and extends into the bore 58. A radial shoulder 55 on the head 54 maximizes the area of contact between adjacent surface 55*a* of the shoulder 55 and the radial end surface 52*a* of the pedestal 52. This reduces the maximum pressure resulting from the compressive riveting loads and the tendency for wear and/or failure of the rigid mounting between the head and pedestal.

The pedestal 52 also includes an integrally formed internal stop 57 for limiting the forward movement of a pilot pin at its normal or return position. More particularly, the internal stop 57 includes a shoulder 57*a* for engaging an upper pilot pin shoulder, such as the shoulder 32 on the pilot pin 18 shown in FIG. 1. The internal stop 57 bears the loads resulting upon return of the pilot pin to its normal or return position during each riveting cycle and inhibits the tendency of such loads to dislodge or loosen the connection between the pedestal 52 and clinching head 54.

Figure 6:
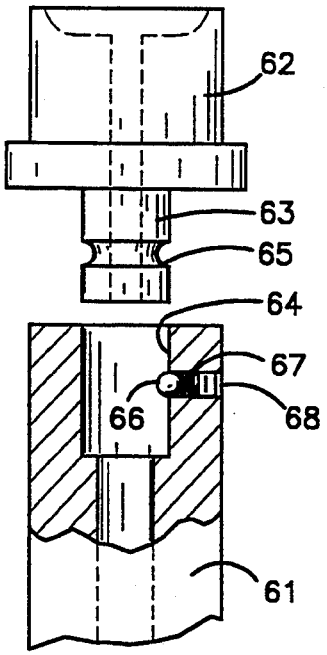
FIG. 6 is a diagrammatic exploded elevational view, partially in section, showing a disposable head anvil having an un-threaded attaching portion and a locking detent mount in accordance with another embodiment of the invention.

Referring to FIG. 6, a disposable head riveting anvil 60 includes a hollow pedestal 61 and a clinching head 62. The anvil 60 is similar to the anvil 50. Accordingly, the head 62 includes a cylindrical head extension 63 which is slidably received in a cylindrical bore 64 in the proximal end of the pedestal 61. The extension 63 includes an annular recess 65 for receiving a detent ball 66 resiliently mounted in the wall of the bore 64 by a spring 67 and locking set screw 68.

Figure 7:
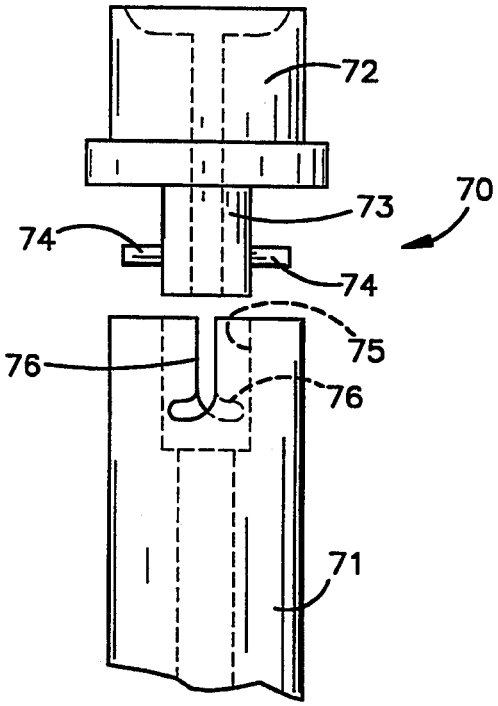
FIG. 7 is a diagrammatic elevational view similar to FIG. 6 showing a locking bayonet mount in accordance with yet another embodiment of the invention.

Referring to FIG. 7, a disposable head riveting anvil 70 includes a hollow pedestal 71 and a clinching head 72. The anvil 70 is similar to the anvil 60, and includes a cylindrical head extension 73 having opposed mounted pins 74. A cylindrical bore 75 is provided in the proximal end of the pedestal 71, and it includes a pair of generally J-shape slots 76 for receiving the pins 74. (The clinching head 72 and pedestal 71 are shown rotated 90° from their engaging position to illustrate both the pins 74 and the slots 76.) The extension 73 is axially advanced into the bore 75 and rotated with the pins 74 riding in associated slots 76 to lock the head 72 and pedestal 71 rigidly together upon full engagement.

Figure 8:
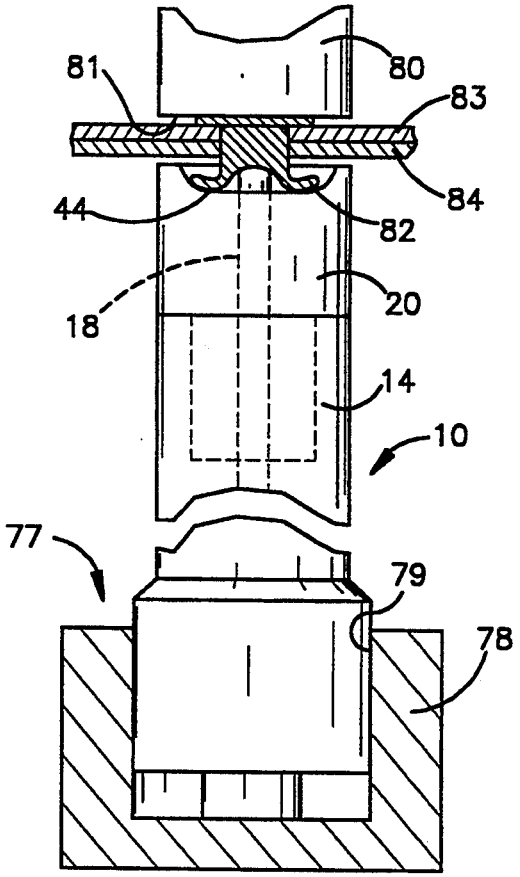
FIG. 8 is a diagrammatic elevational view showing the anvil of FIG. 1 installed in a riveting machine having its driver head disposed at an intermediate point in the clinching of two work pieces together using a semi-tubular rivet.

The operation of the riveting anvil 10 is illustrated in FIG. 8 with a riveting machine 77. The riveting machine 77 includes an anvil mount 78 having a recess 79 for receiving the distal end of the anvil 10 and a driver head 80 having a flat driving surface 81. A semi-tubular rivet 82 for securing two articles together, e.g. a brake shoe lining 83 and a metal brake shoe 84, is disposed between the driver head 80 and the anvil head 20 together with the lining 83 and shoe 84. The semi-tubular rivet has a flat head for engagement with the driving surface 81 of the driver head 80 and a cylindrical shank having a hollow or tubular longitudinal end portion adapted to be rolled to a flattened annular clinching position.

The pilot pin 18 is initially positioned through a pair of aligned riveting holes in the lining 83 and brake shoe 84 with the forward end of the pilot pin in contact with the adjacent longitudinal tubular end of the rivet 82. As the driver head advances, the pilot pin 18 withdraws rearwardly to guide the rivet through the riveting holes in the work pieces. Further closing movement of the driver head 80 and anvil 10 expands the end of the rivet 82. More particularly, the tubular longitudinal end of the rivet 82 is rolled radially outward and then back against the adjacent work piece by engagement with its associated rolling surface 44 to a final riveting position clinching or closely joining the lining 83 to the shoe 84. The driver head 80 and anvil 10 are then moved apart to allow removal of the lined brake shoe. During the riveting operation, the clinching head 20 is fixed against relative axial movement with respect to the pedestal 14 since it is rigidly mounted to the pedestal.

If the rolling surface 44 of the anvil 10 is damaged or worn due to use, the clinching head 20 is replaced and the remaining elements of the anvil 10 are used again. Also, the clinching head 20 may be replaced without removing the anvil 10 from its mounted position in the riveting machine 77 in order to reduce the amount of time the riveting machine is shut down for replacement. In this manner, the anvil costs and/or the production costs associated with machine down-time may be significantly reduced.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A rivet setting anvil removably mountable in a riveting machine, said rivet setting anvil comprising:

a pedestal having distal and proximal ends, an outside wall at the outer periphery thereof extending to a blunt end surface at the distal end and a longitudinal bore centrally extending between said distal and proximal ends, said pedestal distal end being removably retainable along an adjacent mounting portion of said outside wall thereof and said blunt end surface in a fixed position in a generally closed end bore adapted for receiving and supporting said blunt end surface in said riveting machine, said proximal end extending from said riveting machine a distance greater than the longitudinal extent of said mounting portion to a location adjacent a workpiece to be riveted;

a clinching head having a clinching portion, an attaching portion and a bore therebetween, said attaching portion being removably attached to said proximal end to rigidly mount said clinching head to said pedestal with said bores being in communication, said clinching portion having an annular rivet rolling surface located about said head bore for engaging rivets and receiving substantially all compressive loads applied by said riveting machine to said clinching head;

a pilot pin slidably retained in said bores, a portion of said pin being extensible from said clinching portion;

means for urging said pilot pin to extend from said clinching portion;

a removable plug for plugging the bore of said pedestal at the distal end thereof;

said outside wall supporting substantially all of the compressive riveting loads applied by the riveting machine to said clinching head and transmitting said loads to said blunt end surface;

said clinching head including a radially extending surface for engagement with said pedestal to bear substantially all of the compressive riveting loads transmitted to said outside wall; and said blunt end surface engaging said riveting machine and having a size adequate to support and transmit substantially all of the compressive riveting loads to said riveting machine.

2. An anvil according to claim 1, wherein said attaching portion is threadedly connected to said pedestal.

3. An anvil according to claim 2, wherein said threaded connection between said attaching portion and pedestal includes male and female threads, and at least one of said male and female threads are error threads for providing friction to lock said clinching head to said pedestal during use.

4. An anvil according to claim 2, wherein at least one of said outside wall and said clinching head have at least two contraposed flats to facilitate threading and unthreading said attaching portion to said pedestal.

5. An anvil according to claim 1, wherein said attaching portion comprises a head extension sized to be slidably received within said bore of said pedestal, and a lock means operable in said bore between engaged and disengaged positions to assembly and to disassemble said head extension within said bore.

6. An anvil according to claim 5, wherein said lock means comprises a set screw threadedly engaged in said outside wall of said pedestal and extending into said bore for engagement with said head extension.

7. An anvil according to claim 5, wherein said lock means comprises a detent lock.

8. An anvil according to claim 7, wherein said detent lock comprises a detent ball resiliently mounted in said bore for engagement within an annular recess extending around said head extension.

9. An anvil according to claim 5, wherein said lock means comprises a bayonet lock.

10. An anvil according to claim 5, wherein said bayonet lock comprises at least one pin extending laterally from said head extension and said bore includes an inside wall having an axially and arcuately extending slot for receiving said pin.

11. An anvil according to claim 1, wherein said anvil includes an acircular cross-section adjacent at least one location along its length to facilitate attaching and removing said clinching head from said pedestal.

12. An anvil according to claim 1, wherein said plug is a threaded plug and retains said pilot pin and urging means in said bores.

13. An anvil according to claim 1, wherein said attaching portion has a shoulder about said head bore and said pin has a shoulder intermediate its length, said shoulders acting to limit the extension of said pin from said clinching portion.

14. An anvil according to claim 1, wherein said clinching portion is made of a longer wearing material than said pedestal.

15. An anvil according to claim 1, wherein said clinching head radially extending surface is provided by a shoulder radially extending from said clinching head adjacent said attaching portion.

16. An anvil according to claim 1, wherein said pedestal includes an internal stop for limiting the movement of said pilot pin in response to said means urging said pilot pin to extend from said clinching portion.

17. An anvil according to claim 16, wherein said internal stop is integrally formed with said pedestal.

18. A method of riveting using a cylindrical rivet having at least one longitudinal end, a driving head and a rigid anvil arranged to be removably mounted in a riveting machine for closing movement with the driving head, said anvil including a pedestal having a radially extending surface, a clinching head having a clinching portion and an attaching portion having a radially extending surface for removably and rigidly securing said head to said pedestal along said radially extending surfaces, said pedestal having distal and proximal ends, an outside wall at an outer periphery thereof extending to a blunt end surface at the distal end and a longitudinal bore, said pedestal distal end being removably mountable along an adjacent mounting portion of said outside wall thereof and said blunt end surface in a fixed position in a generally closed end bore adapted for receiving and supporting said blunt end surface in said riveting machine and said pedestal proximal end extending from said riveting machine a distance greater than the longitudinal extent of said mounting portion to a location adjacent a workpiece to be riveted, comprising positioning work pieces to be joined between said driving head with said rivet longitudinally extending through aligned riveting holes in the work pieces, moving said driving head and anvil together with said clinching head being fixed relative to said pedestal, rolling said at least one longitudinal end of said rivet radially outward and then back toward the adjacent work piece by engagement with said clinching portion of said anvil head, receiving substantially all of the compressive riveting loads applied by said riveting machine along said clinching portion and transmitting the loads to said outside wall and through said outside wall to said blunt end surface engaging said riveting machine, and replacing said clinching head upon wear or damage to said clinching portion by disconnecting said attaching portion from said pedestal and connecting a different clinching head to said pedestal.

19. The method of claim 18, wherein said clinching portion includes a rivet rolling surface for engaging said rivet.

20. The method of claim 19, wherein said clinching head attaching portion is threadedly engaged with said pedestal.

21. The method of claim 18, wherein said step of replacing the clinching head is done without removing the anvil pedestal from its supported position in said riveting machine.

22. A method of riveting using a cylindrical rivet having at least one longitudinal end, a driving head and a rigid anvil arranged to be removably mounted in a riveting machine for closing movement with the driving head, said anvil including a pedestal having a load supporting outside wall at its outer periphery extending to a blunt end surface and a longitudinal bore centrally extending between distal and proximal ends thereof, a clinching head having a clinching portion and an attaching portion having a bore extending therebetween, said attaching portion also including a radially extending surface, comprising the steps of removably and rigidly securing said head to said pedestal with said bores in communication and said radially extending surface adjacent said proximal end of the pedestal, mounting said distal end of said anvil in a fixed position in a generally closed end bore adapted for receiving and supporting said blunt end surface in said riveting machine along an adjacent mounting portion of said outside wall thereof and said blunt end surface with said pedestal proximal end extending from said riveting machine a distance greater than the longitudinal extent of said mounting portion to a location adjacent workpieces to be riveted, positioning said workpieces to be joined between said driving head and clinching head with said rivet longitudinally extending through aligned riveting holes in the workpieces, moving said driving head and anvil together with said clinching head being fixed relative to said pedestal, rolling said at least one longitudinal end of said rivet radially outward and then back toward the adjacent workpiece by engagement with said clinching portion of said anvil head, receiving substantially all of the compressive riveting loads applied by said riveting machine along said clinching portion and transmitting the loads through said radially extending surface to said outside wall and through said outside wall to said blunt end surface engaging said riveting machine, and replacing said clinching head upon wear or damage to said clinching portion by disconnecting said attaching portion from said pedestal and connecting a different clinching head to said pedestal.

23. The method of claim 22, wherein said anvil, also includes a pilot pin slidably retained in said bores, a portion of said pin being extensible from said clinching portion, and means for urging said pilot pin to extend from said clinching portion, and the further step of engaging said rivet with the end of the extending portion of said pilot pin.

24. The method of claim 23, wherein said anvil also includes a removable plug for plugging the bore of said pedestal at the distal end thereof and retaining said pilot pin and urging means in said bores.

* * * * *